US008952230B2

(12) United States Patent
Bailey, II

(10) Patent No.: US 8,952,230 B2
(45) Date of Patent: Feb. 10, 2015

(54) GUITAR NECK AND BODY ATTACHMENT MECHANISM

(71) Applicant: Robert Linn Bailey, II, Round Rock, TX (US)

(72) Inventor: Robert Linn Bailey, II, Round Rock, TX (US)

( * ) Notice: Subject to any disclaimer, the term of this patent is extended or adjusted under 35 U.S.C. 154(b) by 0 days.

(21) Appl. No.: 14/109,330

(22) Filed: Dec. 17, 2013

(65) Prior Publication Data

US 2014/0165816 A1 Jun. 19, 2014

Related U.S. Application Data

(60) Provisional application No. 61/739,722, filed on Dec. 19, 2012.

(51) Int. Cl.
*G10D 3/06* (2006.01)
*G10D 1/08* (2006.01)

(52) U.S. Cl.
CPC ... *G10D 3/06* (2013.01); *G10D 1/08* (2013.01)
USPC ..... 84/293

(58) Field of Classification Search
CPC ..... G10D 3/06
See application file for complete search history.

(56) References Cited

U.S. PATENT DOCUMENTS 3,550,496 A * 12/1970 Fender ..... 84/293
4,793,236 A * 12/1988 McGuire et al. ..... 84/293
5,125,311 A * 6/1992 Boulanger et al. ..... 84/291
5,305,819 A * 4/1994 Boulanger et al. ..... 144/347
5,353,672 A * 10/1994 Stewart ..... 84/291
6,028,255 A 2/2000 Myronyk
6,353,164 B1 * 3/2002 Corsi ..... 84/293
7,081,575 B1 7/2006 Pieper, Jr. et al.
7,157,634 B1 * 1/2007 Babicz ..... 84/293
7,375,267 B2 * 5/2008 Poschelk ..... 84/291
7,442,865 B2 10/2008 Moghaddam
7,531,729 B1 5/2009 Davis et al.
7,557,281 B1 * 7/2009 Campling ..... 84/293
7,705,224 B1 4/2010 Ward
7,875,782 B1 1/2011 Nechville
7,932,449 B1 4/2011 Minakuchi
8,183,446 B1 * 5/2012 Ward ..... 84/267
2003/0145712 A1 * 8/2003 Steinberger ..... 84/293
2007/0107579 A1 * 5/2007 Babicz ..... 84/293
2007/0163418 A1 7/2007 Allred
2011/0100191 A1 5/2011 Minakuchi
2014/0165816 A1 * 6/2014 Bailey, II ..... 84/293

* cited by examiner

*Primary Examiner* — Robert W Horn
(74) *Attorney, Agent, or Firm* — QuickPatents; Kevin Prince

(57) ABSTRACT

An attachment mechanism for selective attachment of a stringed instrument neck to a stringed instrument body includes a recess formed in the body with a first part of a latch mechanism. The neck includes a capture block at a forward end thereof adapted to fit snugly within the recess of the body and having a second part of the latch mechanism. With the neck seated in the recess of the body, the neck may be pressed down until the first part of the lock mechanism engages the second part of the lock mechanism to lock the neck into the body. A threaded bolt traversing the body may be included to engage a threaded aperture formed in the neck to further secure the neck to the body. A removable bridge and carrying case may be further included.

15 Claims, 10 Drawing Sheets

GUITAR NECK AND BODY ATTACHMENT MECHANISM

CROSS-REFERENCE TO RELATED APPLICATIONS

This application claims the benefit of U.S. Provisional Patent Application 61/739,722, filed on Dec. 19, 2012, and incorporated herein by reference.

STATEMENT REGARDING FEDERALLY SPONSORED RESEARCH AND DEVELOPMENT

Not Applicable.

FIELD OF THE INVENTION

This invention relates to stringed instruments, and more particularly to an attachment mechanism for allowing selective attachment and detachment of a stringed instrument neck from a stringed instrument body.

DISCUSSION OF RELATED ART

Mechanism for allowing selective attachment and detachment of a stringed instrument neck from a stringed instrument body are known in the art. Such a stringed instrument may be a guitar, banjo, ukulele, or the like. However, heretofore such prior art mechanisms do not allow for consistent securing of the neck to the body, which results in inconsistent string tension and adversely affects the sound of the stringed instrument when played. Further, such prior art devices are relatively complicated and result in a conspicuous, unsightly appearance on the stringed instrument. Further, such prior art devices are difficult to utilize and may require tools, which is inconvenient particularly when traveling. Further, the prior art devices result in collapsed stringed instrument configurations that exceed standard checked baggage size limitations by commercial airlines.

For example, US Patent Application 2011/0100191 to Minakuchi on May 5, 2011, teaches a removable neck for a stringed instrument. However, a screwdriver is required to attach and detach such a removable neck. Further, with repeated use such screws can become loosened, affecting the string tension of the instrument adversely. Still further, the screws may damage the instrument if over-tightened and becoming stripped. Likewise, U.S. Pat. No. 4,982,640 to Buscarino on Jan. 8, 1991 and U.S. Pat. No. 7,081,575 to Pieper, Jr. et al. on Jul. 25, 2006 both suffer from the same drawbacks.

PCT Application PCT/EP2008/005655 to Hoshino Gakki Co. Ltd., published on Mar. 26, 2009, and their German Patent DE 102007043796, published on Mar. 19, 2009, both have the additional drawback that reaching the screws from inside the body is difficult even with proper tools.

U.S. Pat. No. 7,442,865 to Moghaddam on Oct. 28, 2008 teaches a guitar neck and strings assembly that is completely removable from a guitar body, but that is too long to take as anything but checked luggage on an airline.

German Patent 102007026655 to Lukas Brunner on Jan. 3, 2008 teaches a removable stringed instrument neck that includes a stopping plate and a latch mechanism that is loosened or tightened manually without tools. However, such a latching mechanism essentially squeezes a neck portion against the body of the guitar in a manner that, if it becomes loose, affects the string tension and the sound of the guitar adversely.

U.S. Pat. No. 6,028,255 to Myronyk on Feb. 22, 2000 teach a similar mechanism with similar drawbacks, except that when loosened only a small lip holds the neck onto the body of the instrument. Thus even a slight loosening of such a mechanism can result in the neck becoming completely disengaged from the body.

U.S. Pat. No. 7,375,267 to Poschelk on May 20, 2008 teaches a detachable neck mechanism that does not require tools to detach and reattach. However, such a product does require significant space within the body of the guitar, which adversely affects the sound of acoustic instruments, such as an acoustic guitar or violin, for example.

Therefore, there is a need for a device that allows a stringed instrument neck to be selectively attached and detached from a stringed instrument body quickly and without tools. Such a needed mechanism would securely and consistently maintain the stringed instrument neck in proper position on the stringed instrument body, even if threaded fasteners thereof become slightly loosened such as during play. Such a needed device would provide a collapsed configuration that is within standard checked baggage size limitations by commercial airlines, and would not adversely affect the sound of the instrument. The present invention accomplishes these objectives.

SUMMARY OF THE INVENTION

The present device is an attachment mechanism for selective attachment of a stringed instrument neck to a stringed instrument body. A recess formed in the stringed instrument body includes a forward stop surface, an upper neck capturing surface, a lower neck capturing surface, and a pair of side walls. The recess further includes a first part of a latch mechanism that is fixed rearward of the forward stop surface.

A stringed instrument neck includes a capture block at a forward end thereof that is adapted to fit snugly between the upper and lower neck capturing surfaces and side walls of the recess. A forward wall of the capture block abuts the forward stop surface of the recess when the stringed instrument neck is in a locked position with the stringed instrument body. The capture block further includes a second part of the latch mechanism fixed rearward of the forward wall of the capture block.

The first part of the latch mechanism includes a latch hook projecting upward out of the recess. The latch hook includes a sloped upper surface and a lip. The latch hook is biased into a forward position with a spring. The second part of the latch mechanism includes an aperture in the capture block that includes a cooperative latch ledge therein. The latch ledge may be included in a latch plug that is fixed within the capture block, or built into the capture block itself The latch hook has an actuator fixed therewith for manually moving the latch hook away from the forward position against the spring into a rearward position.

As such, with the stringed instrument neck seated in the recess of the stringed instrument body, with the forward wall partially contacting the forward stop surface, the neck may be pressed down until the sloped surface contacts the second part of the latch mechanism to move the latch hook away from the forward position to the rearward position until the latch hook lip clears the latch ledge, whereby the spring forces the latch hook back into the forward position to lock the stringed instrument neck into the stringed instrument body in the locked position. To release the stringed instrument neck from the stringed instrument body, the actuator is pressed to force the latch hook into the rearward position, whereby the neck may be pivoted out of the recess of the stringed instrument body.

In a preferred embodiment, a threaded bolt is included that traverses a bolt aperture formed in the stringed instrument body at the recess. The capture block in such an embodiment further includes a cooperative threaded aperture plug formed therein, such that with the stringed instrument neck in the locked position on the stringed instrument body, the bolt may be tightened within the threaded aperture plug to further secure the stringed instrument neck to the stringed instrument body. A distal end of the threaded bolt preferably includes a manually-actuable knob. Even if the threaded bolt is slightly loosened during play, the sound of the instrument will remain consistent due to the latch mechanism being fixed in the locked position.

In one such embodiment, the threaded bolt may be captured within the stringed instrument body between a collar and a collar bolt, with a second biasing spring fixed therebetween. The collar is fixed within the stringed instrument body such that the second biasing spring urges the threaded bolt upward into the recess of the stringed instrument body. The threaded bolt in such an embodiment further includes a low-resistance surface for reducing resistance when the bolt is turned.

In one embodiment of the invention, a removable bridge is fixed with a plurality of stringed instrument strings on a stringed instrument body end thereof. The stringed instrument strings are each fixed with the neck at an opposing neck end thereof. The removable bridge is selectively fixable with a front face of the stringed instrument body such that tension on the strings maintains the bridge on the front face of the stringed instrument body when the stringed instrument neck is in the locked position on the stringed instrument body.

A carrying case may be included that has an interior space adapted for receiving both the stringed instrument body and the stringed instrument neck in stacked relationship, the plurality of stringed instrument strings being fixed at one end with a bridge of the stringed instrument body and fixed at an opposing end to the stringed instrument neck. As such the strings within the case form an arc, the case being adapted to prevent kinking of the stringed instrument strings when the stringed instrument body, strings and neck are stored therein.

The present invention allows a stringed instrument neck to be selectively attached and detached from a stringed instrument body quickly and without tools. The innovative mechanism securely and consistently maintains the stringed instrument neck in proper position on the stringed instrument body when used to attach the stringed instrument neck to the stringed instrument body. The present invention is relatively simple and easy to use manually without tools. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
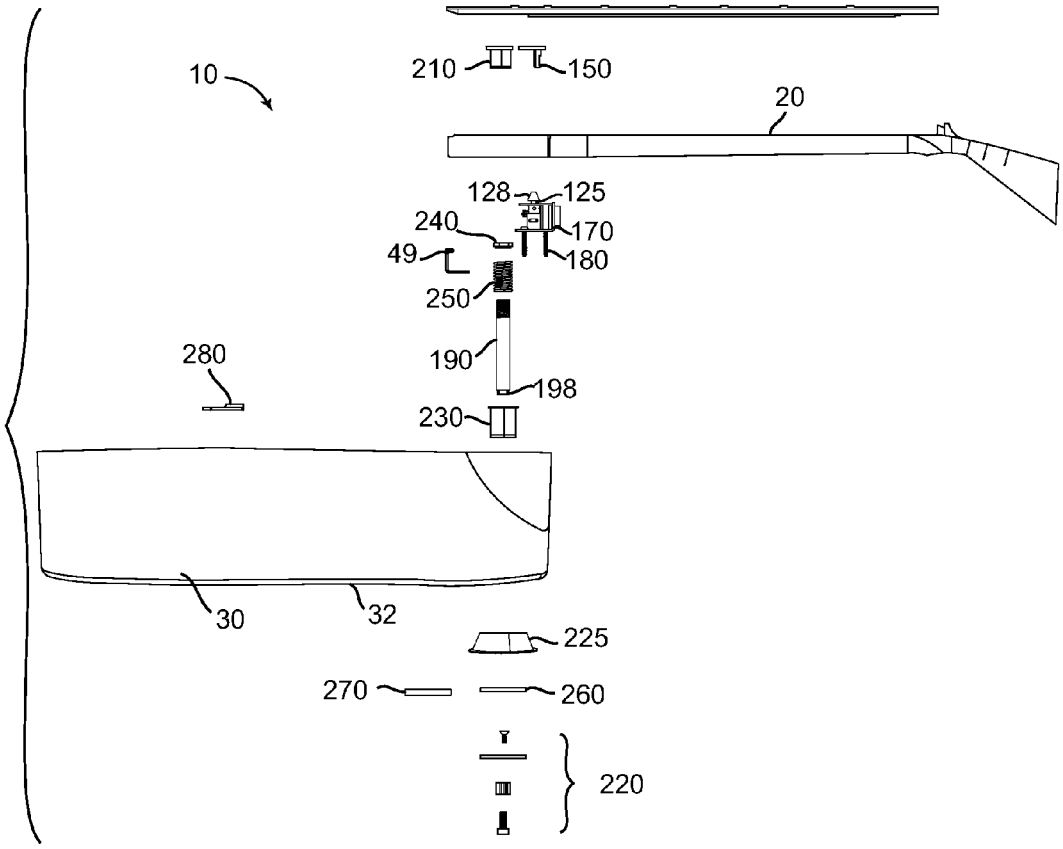
FIG. 1 is an exploded side elevational view of the invention.
Figure 2:
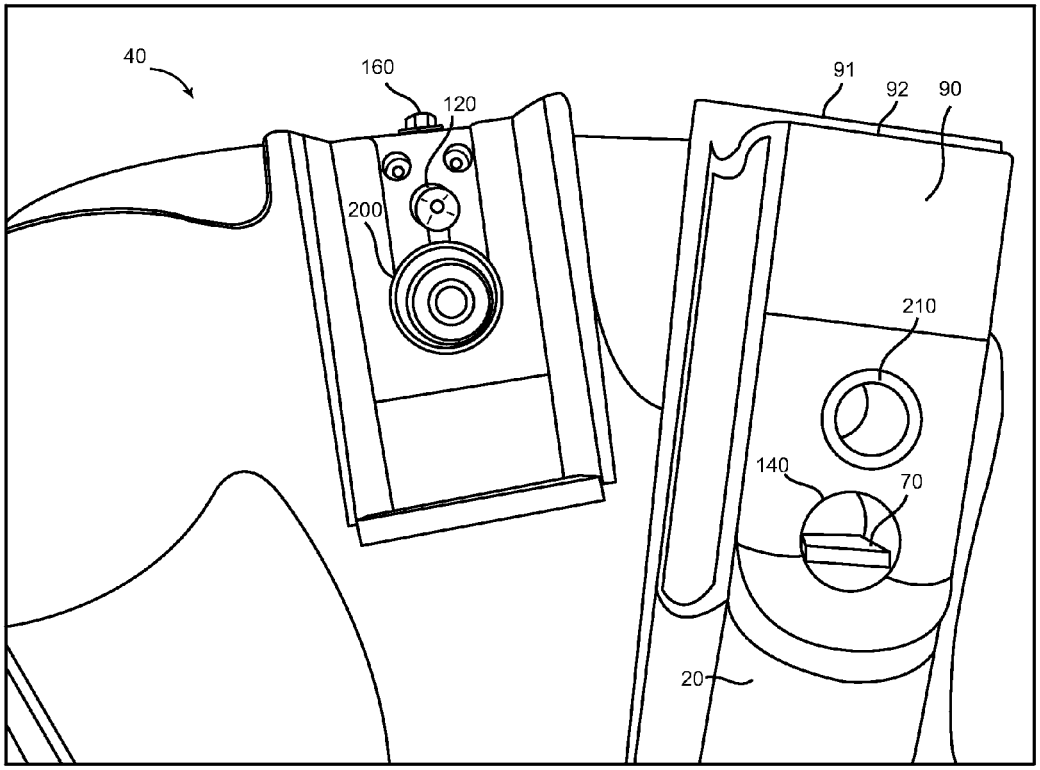
FIG. 2 is a bottom view of a stringed instrument body and stringed instrument neck in an unlocked position.
Figure 3:
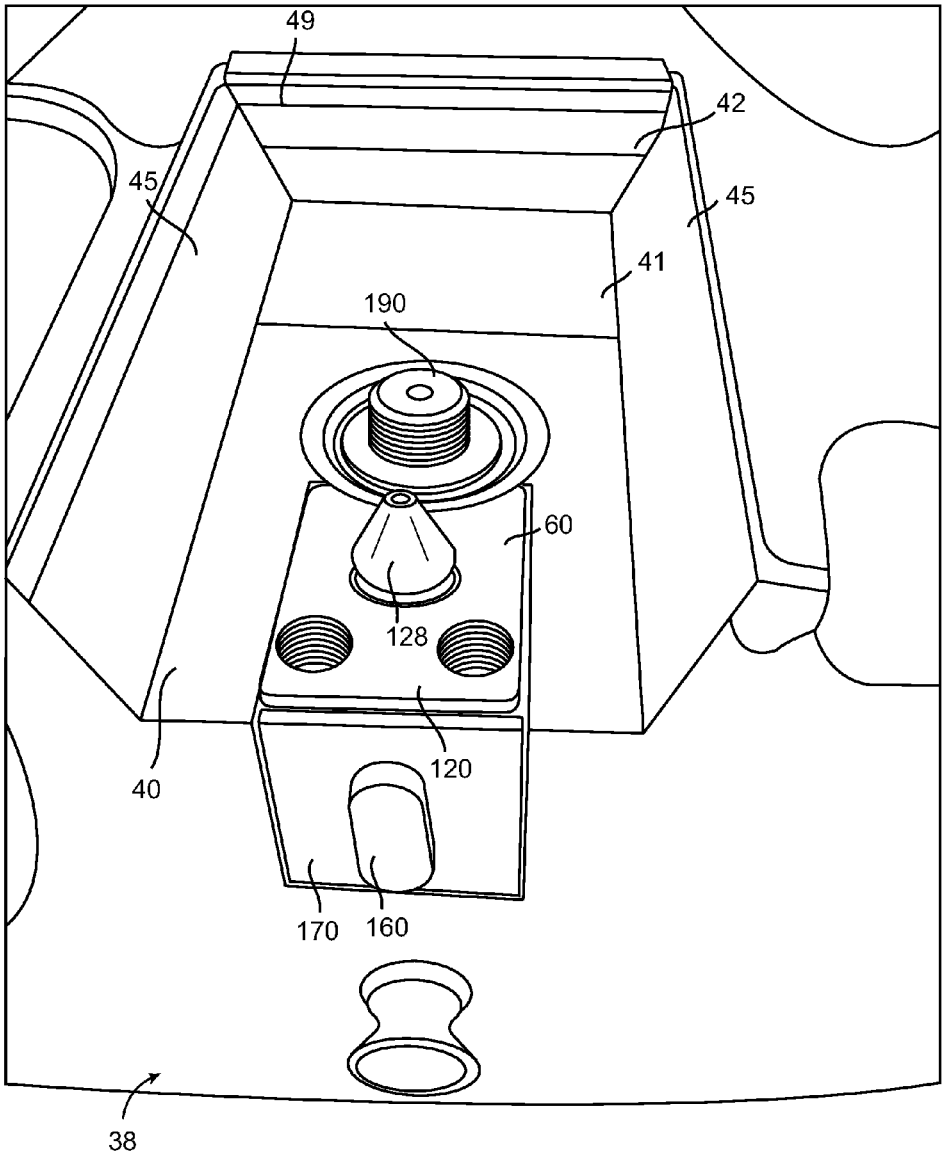
FIG. 3 is a rear perspective view of a recess and first part of a latching mechanism of the stringed instrument body.

FIGS. 1-3 illustrate an attachment mechanism 10 for selective attachment of a stringed instrument neck 20 to a stringed instrument body 30. Such a stringed instrument may be a guitar, banjo, ukulele, or the like. The stringed instrument neck 20 and body 30 may be previously manufactured such that the stringed instrument neck 20 and body 30 are modified to include the components of the attachment mechanism 10. In an alternate embodiment, the stringed instrument neck 20 and body 30 include the components of the attachment mechanism 10 when initially manufactured. In any event, it will be understood that the attachment mechanism 10 may include only those components not included on a prior art stringed instrument, or the invention may incorporate the stringed instrument components as well.

A recess 40 formed in the stringed instrument body 30 includes a forward stop surface 42, an upper neck capturing surface 49, a lower neck capturing surface 41, and a pair of side walls 45. The recess 40 further includes a first part 60 of a latch mechanism 50 that is fixed rearward of the forward stop surface 42.

A stringed instrument neck 20 includes a capture block 90 at a forward end 92 thereof that is adapted to fit snugly between the upper and lower neck capturing surfaces 41,49 and side walls 45 of the recess 40. A forward wall 91 of the capture block 90 abuts the forward stop surface 42 of the recess 40 when the stringed instrument neck 20 is in a locked position 100 with the stringed instrument body 30. The capture block 90 further includes a second part 70 of the latch mechanism 50 fixed rearward of the forward wall 91 of the capture block 90. The upper neck capturing surface 49 is only long enough to vertically capture the capture block 90 while still allowing the neck 20 to pivot to become engaged thereunder. The upper neck capturing surface 49 may be a metallic plate added to the stringed instrument body 30, for example, or be formed in the material of the stringed instrument body 30 itself. As such, the stringed instrument neck 20 may pivot about the upper neck capturing surface 49 to allow the first and second parts 60,70 of the latch mechanism 50 to become mutually engaged.

The first part 60 of the latch mechanism 50 includes a latch hook 120 projecting upward out of the recess 40. The latch hook 120 includes a sloped upper surface 128 and a lip 125. The latch hook 120 is biased into a forward position 105 with a spring 130. The second part 70 of the latch mechanism 50 includes an aperture 140 in the capture block 90 that includes a cooperative latch ledge 150 therein. The latch ledge 150 may be included in a latch plug that is fixed within the capture block 90, or built into the capture block 90 itself The latch hook 120 has an actuator 160 fixed therewith for manually moving the latch hook 120 away from the forward position 105 against the spring 130 into a rearward position 115. Preferably the actuator 160 projects slidably outwardly from a rear end 38 of the stringed instrument body 30.

Figure 6A:
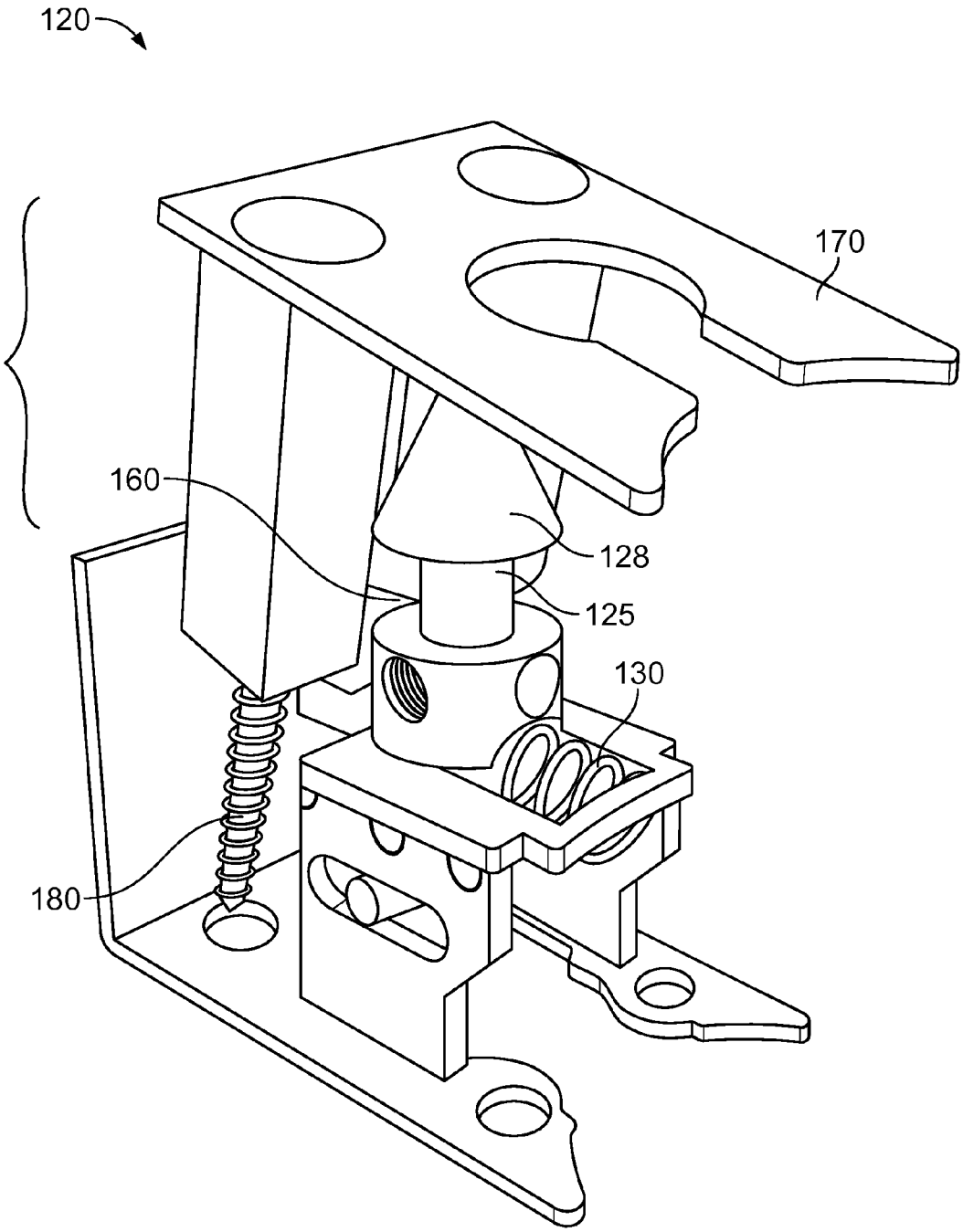
FIG. 6A is an exploded perspective view of the first part of the latching mechanism.
Figure 6B:
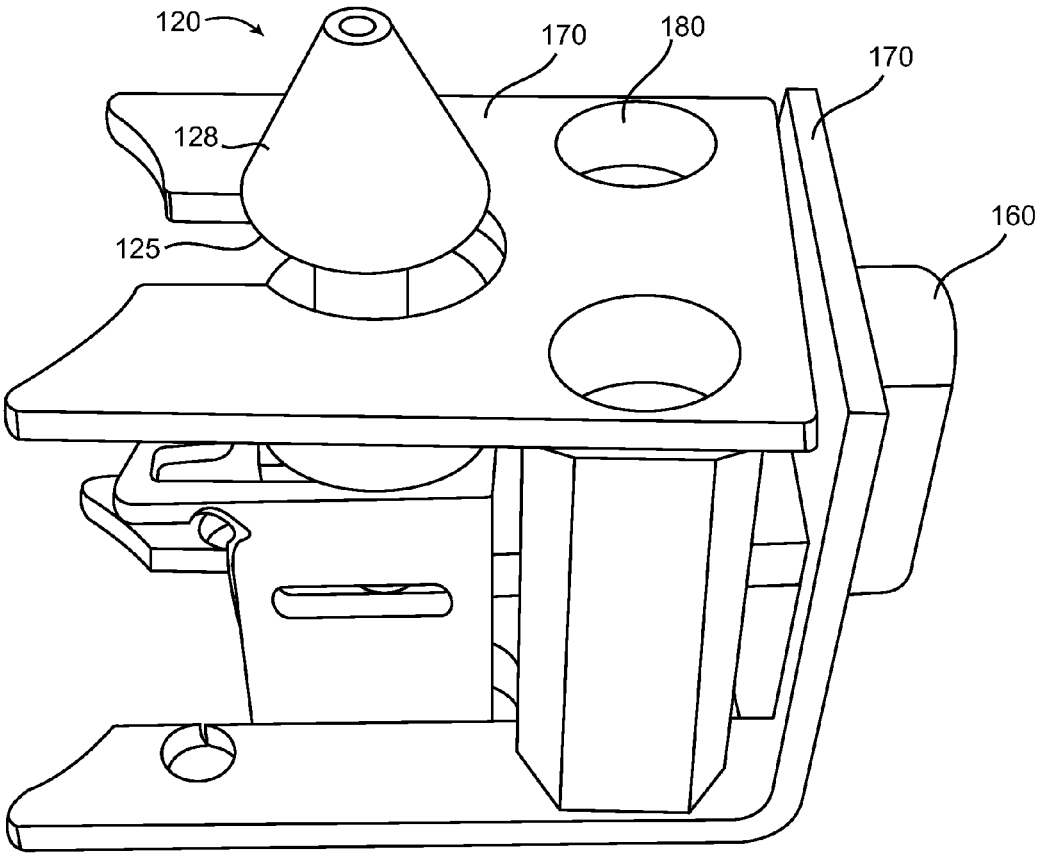
FIG. 6B is an assembled perspective view of FIG. 6A.

In one embodiment, the second part 70 of the latch mechanism 50 includes a rigid frame 170 (FIGS. 6A and 6B) that supports the slidably supports the latch hook 120, spring 130 and actuator 160. The rigid frame 170 further includes at least one mechanical fastener 180, such as a threaded screw, adapted to secure the frame 170 to the stringed instrument body 30 at the recess 40. The frame 170 may be formed from a metallic sheet material, for example.

As such, with the stringed instrument neck 20 seated in the recess 40 of the stringed instrument body 30, with the forward wall partially contacting the forward stop surface 42, the neck 20 may be pressed down until the sloped surface 128 contacts the second part 70 of the latch mechanism 50 to move the latch hook 120 away from the forward position 105 to the rearward position 115 until the latch hook lip 125 clears the latch ledge 150, whereby the spring 130 forces the latch hook 120 back into the forward position 105 to lock the stringed instrument neck 20 into the stringed instrument body 30 in the locked position 100. To release the stringed instrument neck 20 from the stringed instrument body 30, the actuator 160 is pressed to force the latch hook 120 into the rearward position 115, whereby the neck 20 may be pivoted out of the recess 40 of the stringed instrument body 30.

Figure 4:
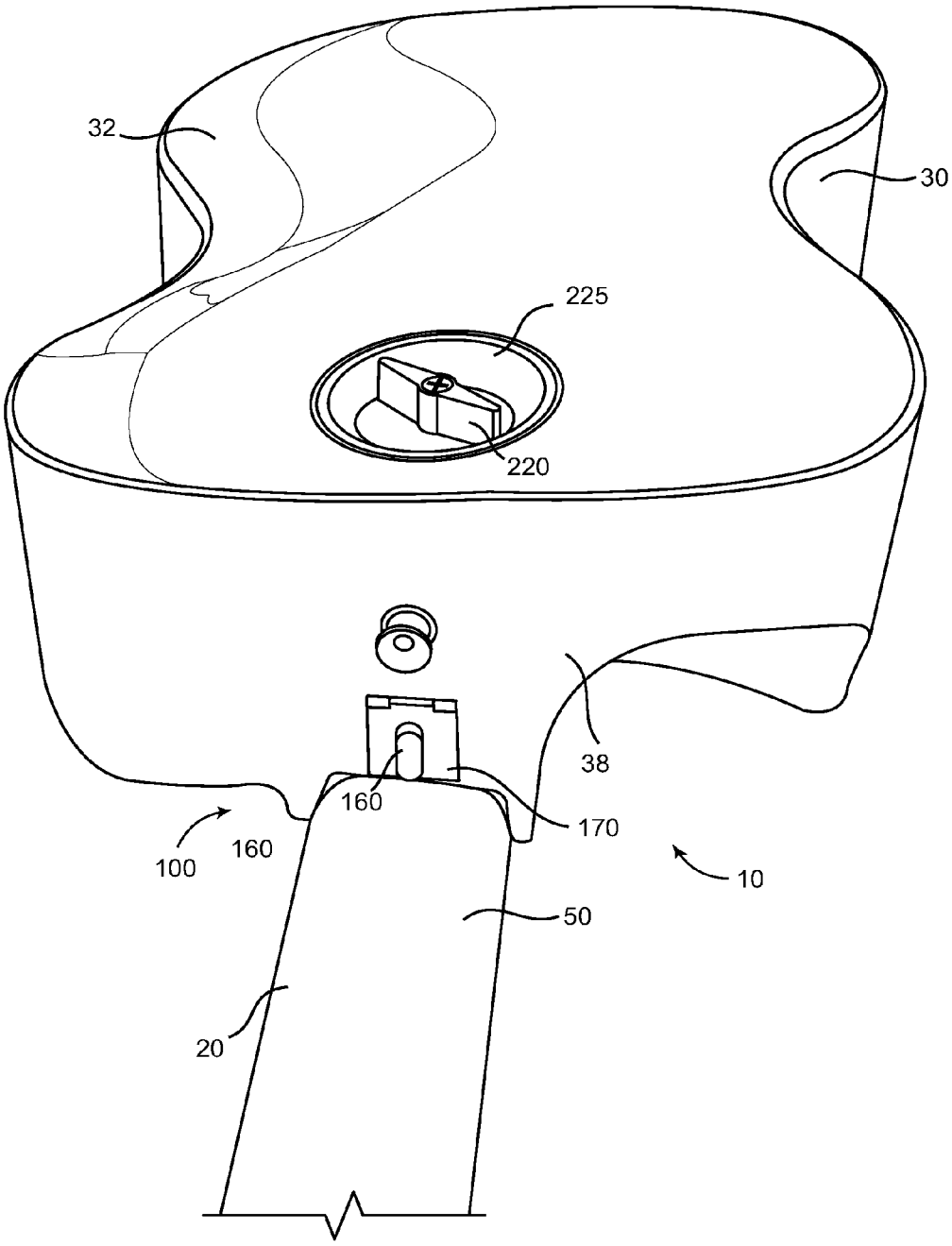
FIG. 4 is a bottom rear perspective view of the stringed instrument body and stringed instrument neck in a locked position.
Figure 7:
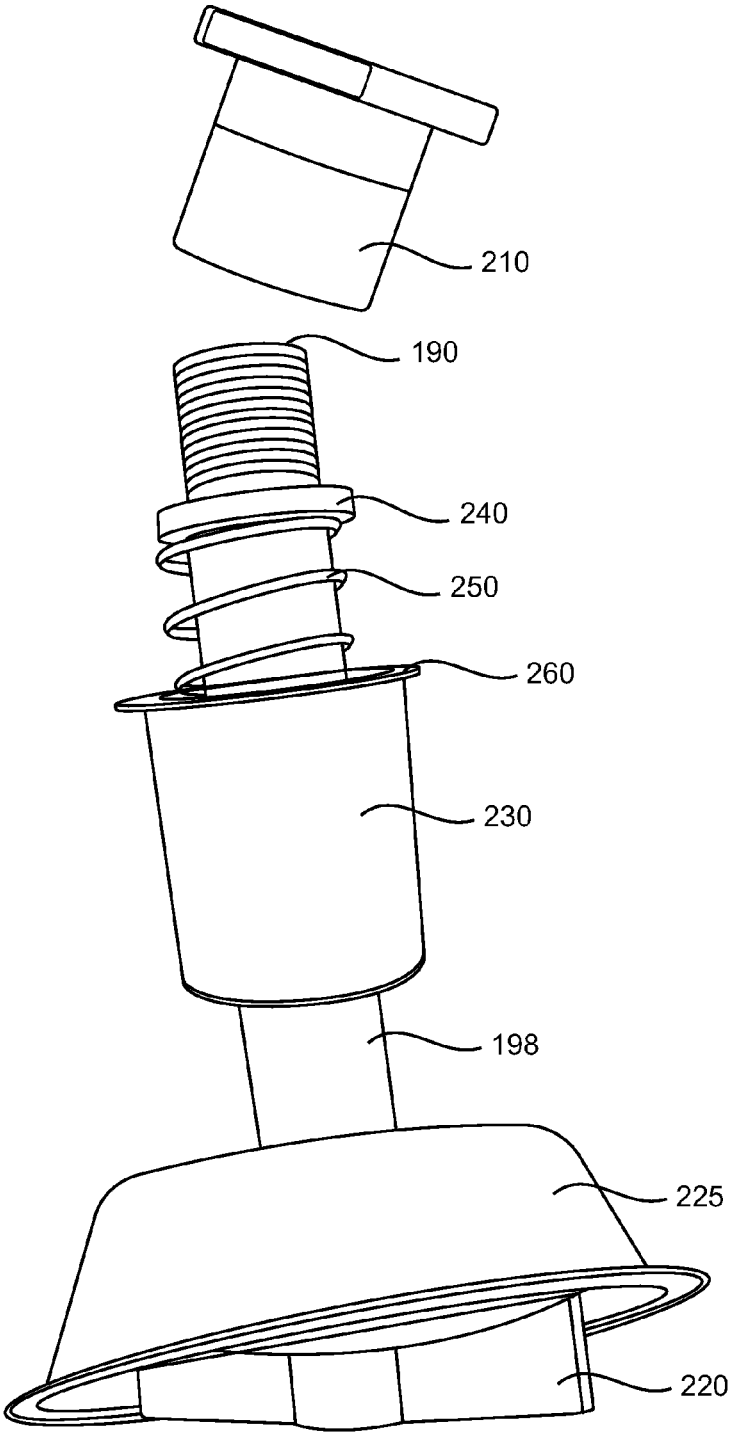
FIG. 7 is a top plan view of a threaded bolt of the invention.

In a preferred embodiment, a threaded bolt 190 is included that traverses a bolt aperture 20 formed in the stringed instrument body 30 at the recess 40. The capture block 90 in such an embodiment further includes a cooperative threaded aperture plug 210 formed therein, such that with the stringed instrument neck 20 in the locked position 100 on the stringed instrument body 30, the bolt 190 may be tightened within the threaded aperture plug 210 to further secure the stringed instrument neck 20 to the stringed instrument body 30. A distal end 198 of the threaded bolt 190 preferably includes a manually-actuable knob 220 (FIGS. 4 and 7). The knob 220 is preferably recessed within a bottom side 32 of the stringed instrument body 30 lined with a bushing 225, such that a top of the knob 220 is flush or recessed below the bottom side 32 of the stringed instrument body 30.

In one such embodiment, the threaded bolt 190 may be captured within the stringed instrument body 30 between a collar 230 and a collar bolt 240, with a second biasing spring 250 fixed therebetween. The collar 230 is fixed within the stringed instrument body 30 such that the second biasing spring 250 urges the threaded bolt 190 upward into the recess 40 of the stringed instrument body 40. The threaded bolt 190 in such an embodiment further includes a low-resistance surface 260, such as a Teflon® washer (FIG. 1) or the like, for reducing resistance when the bolt 190 is turned. Alternately, the threaded bolt 190 may include a thrust bearing 270 (FIG. 1) for further reducing the resistance when the bolt 190 is turned.

In one embodiment of the invention, a removable bridge 280 is fixed with a plurality of stringed instrument strings 15 on a stringed instrument body end 16 thereof. The stringed instrument strings 15 are each fixed with the neck 20 at an opposing neck end 17 thereof. The removable bridge 280 is selectively fixable with a front face 31 of the stringed instrument body 30 such that tension on the strings 15 maintains the bridge 280 on the front face 31 of the stringed instrument body 30 when the stringed instrument neck 20 is in the locked position 100 on the stringed instrument body 30. The front face 31 of the stringed instrument body 30 may include a plurality of keyhole apertures 290, and a bottom side of the removable bridge 280 may include cooperative key projections 300 each adapted for insertion into one of the keyhole apertures 290 and for sliding towards the neck 20 to maintain a consistent tension on each of the stringed instrument strings 15 when the stringed instrument neck 20 is in the locked position on the stringed instrument body 30.

Figure 5:
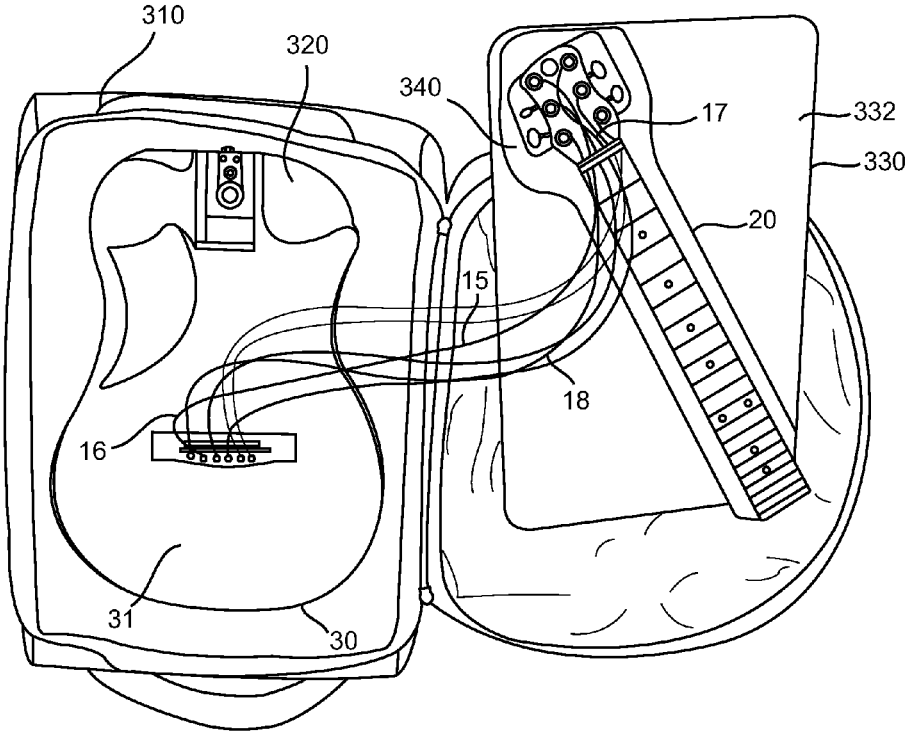
FIG. 5 is a top plan view of a carrying case of the invention, illustrated in an open position.
Figure 8:
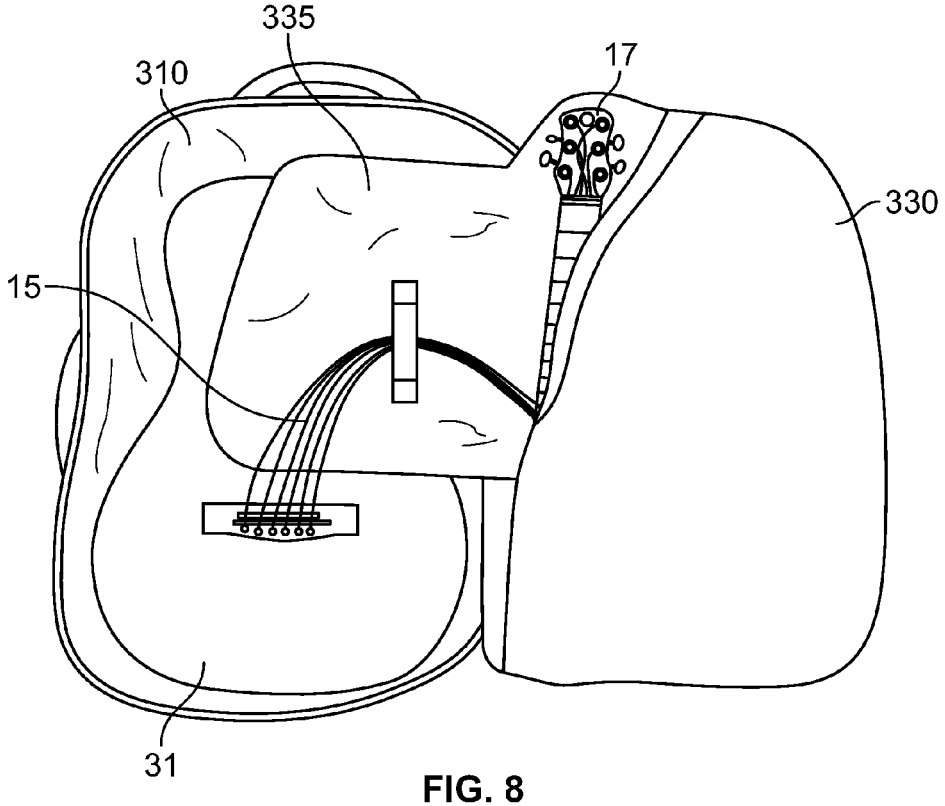
FIG. 8 is a top plan view of an alternate carrying case of the invention, illustrated in the open position.

A carrying case 310 (FIGS. 5 and 8) may be included that has an interior space 320 adapted for receiving both the stringed instrument body 30 and the stringed instrument neck 20 in stacked relationship, the plurlity of stringed instrument strings 15 being fixed at one end with a bridge of the stringed instrument body 30 and fixed at an opposing end to the stringed instrument neck 20. As such the strings 15 within the case 310 form an arc 18, the case 310 being adapted to prevent kinking of the stringed instrument strings 15 when the stringed instrument body 30, strings 15 and neck 20 are stored therein. The case 310 may include a case divider 330 that has a recess 340 for receiving the stringed instrument neck 20 and strings 15 on a front side 332 thereof, and an opposing recess 350 for receiving the stringed instrument body 30 and the strings 15 on a rear side 338 thereof. The strings form the arc 18 within the case 310 such that the strings are not kinked when held within the case 310 and when the case is closed (not shown). The case 310 and divider 330 may be made from a resilient or rigid material, such that the case 330 protects the stringed instrument neck 20 and body 30 when contained therein. In one embodiment, the divider 330 includes an additional flap 335 for holding the strings in place in the arc 18 while the case 310 is opened and closed.

Figure 9A:
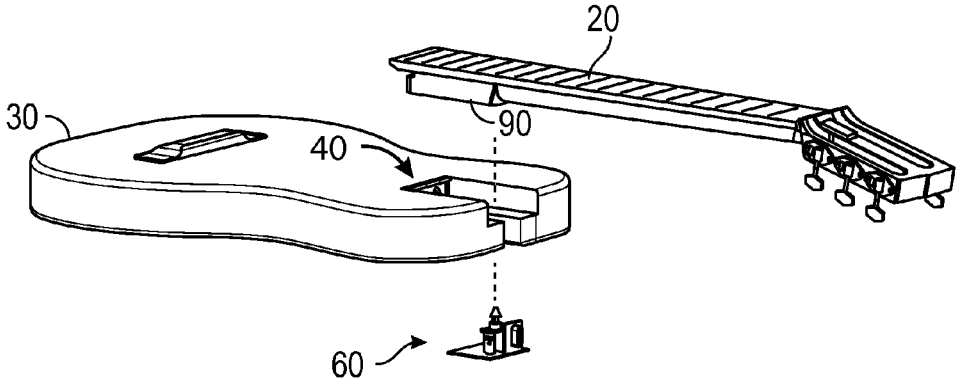
FIG. 9A is an exploded top perspective view of an alternate embodiment of the invention.
Figure 9B:
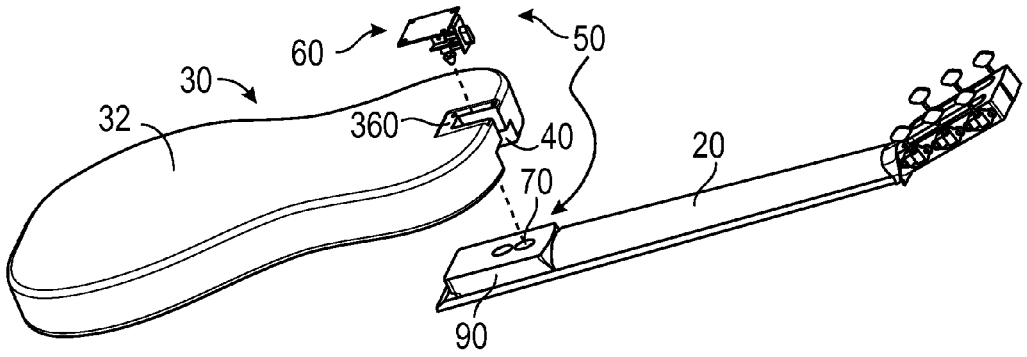
FIG. 9B is an exploded bottom perspective view of the embodiment of FIG. 9A.

In one embodiment of the invention, the stringed instrument body 30 further includes a latch mechanism recess 360 formed in a bottom side 32 thereof that is adapted to receive the first part 60 of the latch mechanism 50 (FIGS. 9A and 9B). As such, with the stringed instrument neck 30 seated in the recess 40 of the stringed instrument body 30 with the forward wall 91 partially contacting the forward stop surface 42, and with the first part 60 of the latch mechanism 50 held within the latch mechanism recess 360, the neck 20 may be pressed down into the stringed instrument body 30 into the locked position 100 as previously described. In such an embodiment, the body 30 is sandwiched or squeezed between the first part 60 of the latch mechanism 50 and the capture block 90 of the guitar neck 20.

While a particular form of the invention has been illustrated and described, it will be apparent that various modifications can be made without departing from the spirit and scope of the invention. For example, in one embodiment of the invention, the components of the invention can be included as a kit with instructions on how to modify an existing stringed instrument. Alternately, the invention may be integrated into the stringed instrument during manufacturing of the instrument. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An attachment mechanism for selective attachment of a stringed instrument neck to a stringed instrument body, comprising:

a recess formed in the stringed instrument body including a forward stop surface, upper and lower neck capturing surfaces, and side walls, the recess further including a first part of a latch mechanism fixed rearward of the forward stop surface; and the stringed instrument neck having a capture block at a forward end thereof adapted to fit snugly between the upper and lower neck capturing surfaces and side walls of the recess, a forward wall of the capture block abutting the forward stop surface of the recess when the stringed instrument neck is in an locked position with the stringed instrument body, the capture block further including a second part of the latch mechanism fixed rearward of the forward wall of the capture block;

the first part of the latch mechanism including a latch hook projecting upward out of the recess and having a sloped upper surface and a lip, the latch hook being biased into a forward position with a spring, the second part of the latch mechanism including an aperture in the capture block and including a cooperative latch ledge therein, the latch hook having an actuator fixed therewith for manually moving the latch hook away from the forward position against the spring into a rearward position;

whereby with the stringed instrument neck seated in the recess of the stringed instrument body with the forward wall partially contacting the forward stop surface, the neck may be pressed down until the sloped surface contacts the second part of the latch mechanism to move the latch hook away from the forward position to the rearward position until the latch hook lip clears the latch ledge, the spring thereafter forcing the latch hook back into the forward position to lock the stringed instrument neck into the stringed instrument body into the locked position.

2. The attachment mechanism of claim 1 wherein the second part of the latch mechanism includes a rigid frame supporting the latch hook, spring and actuator, and further including at least one mechanical fastener adapted to secure the frame to the stringed instrument body.

3. The attachment mechanism of claim 1 wherein the stringed instrument body further includes a threaded bolt traversing a bolt aperture in the stringed instrument body at the recess, and wherein the capture block further includes a cooperative threaded aperture plug formed therein, such that with the stringed instrument neck in the locked position on the stringed instrument body, the bolt may be tightened within the threaded aperture plug to further secure the stringed instrument neck to the stringed instrument body.

4. The attachment mechanism of claim 3 wherein a distal end of the threaded bolt includes a manually-actuable knob.

5. The attachment mechanism of claim 4 wherein the knob is recessed within a bottom side of the stringed instrument body.

6. The attachment mechanism of claim 4 wherein the threaded bolt is captured within the stringed instrument body between a collar and a collar bolt, a second biasing spring fixed therebetween, the collar fixed within the stringed instrument body, such that the second biasing spring urges the threaded bolt upward into the recess of the stringed instrument body.

7. The attachment mechanism of claim 6 wherein the threaded bolt further includes a low-resistance surface for reducing resistance when the bolt is turned.

8. The attachment mechanism of claim 6 wherein the threaded bolt further includes a thrust bearing for reducing resistance when the bolt is turned.

9. The attachment mechanism of claim 1 further including a removable bridge fixed with a plurality of stringed instrument strings on a stringed instrument body end thereof, the stringed instrument strings each fixed with the neck at an opposing neck end thereof, the removable bridge selectively fixable with a front face of the stringed instrument body such that tension on the strings maintains the bridge on the front face of the stringed instrument when the stringed instrument neck is in the locked position on the stringed instrument body.

10. The attachment mechanism of claim 9 wherein the front face of the stringed instrument body includes a plurality of keyhole apertures, and wherein a bottom side of the removable bridge includes cooperative key projections each adapted for insertion into one of the keyhole apertures and for sliding towards the neck to maintain a consistent tension on each of the stringed instrument strings when the stringed instrument neck is in the locked position on the stringed instrument body.

11. The attachment mechanism of claim 9 wherein a bottom side of the removable bridge includes a plurality of keyhole apertures, and wherein a bottom side of the front face of the stringed instrument body includes cooperative key projections each adapted for insertion into one of the keyhole apertures and for sliding of the bridge towards the neck to maintain a consistent tension on each of the stringed instrument strings when the stringed instrument neck is in the locked position on the stringed instrument body.

12. The attachment mechanism of claim 1 further including a carrying case having an interior space adapted for receiving both the stringed instrument body and the stringed instrument neck in stacked relationship while a plurality of stringed instrument strings is fixed at one end with a bridge of the stringed instrument body and fixed at an opposing end to the stringed instrument neck, the strings within the case forming an arc, the case adapted to prevent kinking of the stringed instrument strings when the stringed instrument body, strings and neck are stored therein.

13. The attachment mechanism of claim 12 further including a case divider having a recess for receiving the stringed instrument neck and strings on a front side thereof, and an opposing recess for receiving the stringed instrument body and the strings on a rear side thereof, the strings forming the arc loop within the case such that the strings are not kinked when held therein.

14. The attachment mechanism 1 wherein the actuator of the second part of the latch mechanism projects slidably outwardly from a rear end of the stringed instrument body.

15. The attachment mechanism of claim 1 wherein the stringed instrument body further includes a latch mechanism recess formed in a bottom side thereof and adapted to receive the first part of the latch mechanism, whereby with the stringed instrument neck seated in the recess of the stringed instrument body with the forward wall partially contacting the forward stop surface, and with the first part of the latch mechanism held within the latch mechanism recess, the neck may be pressed down until the sloped surface contacts the second part of the latch mechanism to move the latch hook away from the forward position to the rearward position until the latch hook lip clears the latch ledge, the spring thereafter forcing the latch hook back into the forward position to lock the stringed instrument neck into the stringed instrument body into the locked position.

* * * * *